US009745115B2

(12) United States Patent
Hall

(10) Patent No.: US 9,745,115 B2
(45) Date of Patent: Aug. 29, 2017

(54) MULTI-COMPARTMENT, PORTABLE BEVERAGE CONTAINER

(71) Applicant: Joshua Hall, San Diego, CA (US)

(72) Inventor: Joshua Hall, San Diego, CA (US)

(73) Assignee: Joshua Hall, San Diego, CA (US)

( * ) Notice: Subject to any disclaimer, the term of this patent is extended or adjusted under 35 U.S.C. 154(b) by 63 days.

(21) Appl. No.: 14/528,532

(22) Filed: Oct. 30, 2014

(65) Prior Publication Data

US 2015/0225130 A1 Aug. 13, 2015

Related U.S. Application Data

(60) Provisional application No. 61/938,093, filed on Feb. 10, 2014.

(51) Int. Cl.
*B65D 5/56* (2006.01)
*B65D 81/32* (2006.01)

(52) U.S. Cl.
CPC ..... *B65D 81/3211* (2013.01)

(58) Field of Classification Search
USPC ..... 206/219, 221
See application file for complete search history.

(56) References Cited

U.S. PATENT DOCUMENTS 3,741,383 A * 6/1973 Wittwer ..... B65D 81/3216 206/219
4,927,012 A * 5/1990 Rowe ..... B65D 81/3272 206/219
6,305,576 B1 10/2001 Leoncavallo
6,517,878 B2 * 2/2003 Heczko ..... A23L 2/00 206/219
6,959,839 B2 11/2005 Roth et al.
7,306,117 B2 12/2007 Roth et al.
7,909,210 B2 3/2011 Roth et al.
8,011,534 B2 9/2011 Roth et al.
8,434,401 B2 5/2013 Skalski et al.
8,499,971 B2 8/2013 Roth et al.
8,678,183 B2 * 3/2014 Jones ..... B67B 3/20 206/219
8,944,293 B2 2/2015 Roth et al.
2002/0020302 A1 2/2002 Heczko
(Continued)

FOREIGN PATENT DOCUMENTS

WO WO9624542 8/1996
WO WO2009149184 A2 12/2009

OTHER PUBLICATIONS

Fuelshaker, "FuelShaker Pro—A New Product Designed to Inspire Hydration and Change Supplement Consumption Forever", 2015, 3pgs.

(Continued)

*Primary Examiner* — Jacob K Ackun

(57) ABSTRACT

A mixing container having a first housing with a first compartment in operative communication with a second compartment which may be configured as a cartridge. A concentrate in the second compartment may be mixed with a solution held in the first compartment by a compression of the first compartment which will either permanently open a valve to communicate with the second compartment or sequentially open the valve to allow a sequentially stronger mixture of concentrate with the fluid in the first compartment.

3 Claims, 7 Drawing Sheets

(56) References Cited

U.S. PATENT DOCUMENTS

| | | | | |
|---|---|---|---|---|
| 2006/0113201 | A1 | 6/2006 | Miele et al. | |
| 2007/0138033 | A1* | 6/2007 | Cho | B65D 81/3222 206/219 |
| 2007/0221601 | A1* | 9/2007 | Eitrheim | A61J 11/002 215/6 |
| 2008/0035668 | A1* | 2/2008 | Foster | B05B 11/0056 222/1 |
| 2009/0301032 | A1* | 12/2009 | Sillince | B65D 81/3222 53/428 |
| 2009/0301904 | A1* | 12/2009 | Bullard | A61J 9/001 206/221 |
| 2010/0025350 | A1* | 2/2010 | Kenney | B65D 81/3222 215/6 |
| 2010/0213156 | A1* | 8/2010 | Belnap | A61J 1/2093 215/6 |
| 2011/0011755 | A1* | 1/2011 | Cohen | B65D 81/3227 206/219 |
| 2011/0233118 | A1* | 9/2011 | Nelson | B05B 11/3001 210/117 |

OTHER PUBLICATIONS www.lifefuels.com, "The Nutrition to Reach Your Health and Fitness Goals", 6pgs.
www.umoro.com, 2015, 5pgs.
www.pod.life, "The Ultimate On-the-Go Delivery System", 6pgs.
Cool Gear Intl, LLC, "Aquaburst", 2 pgs (photo of product).

* cited by examiner

MULTI-COMPARTMENT, PORTABLE BEVERAGE CONTAINER

This application claims priority to U.S. Provisional Patent Application Ser. No. 61/938,093 filed on Feb. 10, 2014.

BACKGROUND OF THE INVENTION

1. Field of the Invention

The present invention relates to beverage containers. More importantly, it relates to beverage containers configured to mix an onboard powder or liquid concentrate held in a second chamber, with a contained fluid or water supply, to yield a fresh beverage mixture to the user. The device employing compartments separated by a valve mechanism provides for a separation of water or liquid from the concentrate flavoring or supplement which allows for a user-controlled mixing of liquid upon either a squeezing or the imparting of an impact to the device. The device can employ permanent secondary compartments or employ replaceable concentrated cartridges.

2. Prior Art

Portable beverage containers exist in prior art in many forms that serve a broad range of purposes. These containers range from those that are intended to thermally insulate their contents, to easily-dispensed and robust containers intended for active use. The portable beverage containers that exist today also range in material composition, weight and dispensing mechanisms. There also exists in prior art heavy metal canteens with screw top lids for casual use, as well as light plastic containers with squirt-top lids intended for use while running, jogging or the like.

The employment of portable beverage containers in the fitness world today has become popular since hydration is recognized as a critical component for maintaining energy during physical activity. Maintaining proper body hydration while performing physically demanding tasks is widely recognized as critical for maintaining energy as well as reducing the risk of cramping, loss of consciousness and confusion.

In recent years, dietary supplements and mixed drinks such as protein shakes and electrolyte supplements have become popular in the fitness community. These dietary supplements allow users to increase their protein and electrolyte intake before, during and after strenuous workouts, thereby allowing their body to accomplish more than possible when simply ingesting water. However, the introduction of many supplements to water in a portable beverage container creates further complications. Once a supplement is mixed with water, there is a limited time for ingesting it whereafter the supplement may not provide its intended results, or it may spoil entirely and be rendered inedible depending on varying environmental and storage conditions. Further, the container must be rinsed and cleaned soon thereafter or bacteria can grow and multiply using the rich food source onboard.

To prevent the spoiling and premature expiration of mixed supplement drinks, and to enhance the freshness of the mix, multi-compartment beverage containers exist in prior art, such as the container described in US 20130279287. This container allows a user to maintain separation of supplements and water in a single carry device without the need for bags or separate containment devices. However, during physical activity such as running or jogging, it can be very inconvenient to utilize this second compartment. The aforementioned device requires one to unscrew the bottom area where the supplement fluid or liquid is held, and manually deposit the mix into the main compartment housing the supply of water or other hydrating fluid.

A solution to this manual mixing requirement is also present in prior art as shown in US 20060113201 which teaches a valved, two compartment container. This prior art describes a beverage container possessing a one way valve to allow supplement fluid to pass from its compartment to the main compartment containing hydrating fluid. In order to pass the supplement fluid to mix into the hydrating container, the container must be held with one hand while a manual screw or dispensing mechanism must be activated with a second hand and requires the single mixing of all of the fluid with the supplement fluid.

This solution is undesired in many active settings where a two-handed activation or precision operation may be difficult to achieve and for some users, small mixing of fluid with supplement over time is desired rather a total mixing in a single action. Also, the one way mechanism described proves to be inadequate for powder supplements and mixers. This lack of powdered supplement accommodation proves to be unacceptable since the need to mix such supplements with a hydrating fluid while on the go in active environments is in great demand.

As such, there is a continual and unmet need for an improved device and system for storage of fluid and a supplement or other reservoir of fluid-enhancing mix. Such a device should be formed of easily-engaged components capable of housing a mix such as a fluid or powder in a portable beverage container also having a reservoir of fluid such as water. Further, such a device should allow the mixing of fluids, powders or both in a one-handed operation, to accommodate extreme environmental and active circumstances of use.

Concurrently, such a device should allow a user a mode of operation allowing for an incremental partial mixing of the water supply with onboard fluids or powders to a complete dilution. Such a partial mixing over time would allow ongoing sequential activations to increase or decrease the flavoring or supplement mixed with the water or other liquid stored in the reservoir side of the container.

Finally such a device and method should allow for the easy cleaning and more preferably, easy replacement of onboard compartments, and especially valves therebetween, such as with replaceable cartridges, to maintain the container free of bacteria and odors.

SUMMARY OF THE INVENTION

The device and method herein disclosed and described achieves the above-mentioned goals through the provision of a multi-compartment, portable beverage container with a compression or pressure activated means for mixing of the fluid in a first compartment with a supplement or flavoring stored in a second compartment which may be permanent or in a preferable mode, is a replaceable cartridge. The pressure imparted by the single hand of a user to the first compartment provides a means for mixing the liquid with the stored concentrate, supplement, or flavoring held in the second compartment or cartridge providing a second compartment.

In a preferred mode, a spring-like or reversible flow valve mechanism and seal separates the compartments housing a fluid or water supply, from a concentrate or a mixture supply for dilution in the fluid supply. The valve mechanism responds to pressure to direct the flow of fluid between the compartments and provides a pressure actuated means for mixing. In another preferred mode, the second container is formed as a cartridge which is removably engageable with the housing of the device. The cartridge is formed of polymeric material which is removably engageable in sealed communication with the fluid supply in the first compartment when installed to the housing of the device. The cartridge mode of the device allows the user to have a plurality of such engageable containers of supplements or flavorings or other mixtures which can be removably engaged for mixing the onboard concentrate with the fluid or water supply in the first compartment. The cartridges can be available in a wide variety of supplements and flavor concentrates and the like, and can be engaged by the user according to their anticipated use of the device.

In all modes, the device features a housing having a main fluid containment area or compartment adapted to hold a supply of water or another liquid desired for mixing with the supplement or flavoring or other concentrate stored in a second compartment which is selectively communicable with the fluid in the first compartment. In use, the fluid in the first compartment may be placed in total, or in incremental communication with a removable solute or mixture in the second compartment or cartridge. Communication of fluid between the first compartment and the second compartment is activated by a user compression of the first compartment hosting the fluid to induce a fluid flow to and between the two compartments.

In one mode of operation, this pressure-induced fluid flow may be controlled by a dampened spring-like valve mechanism and which may also operated as an optional amalgamating membrane or webbing. Alternately, the means for pressure induced fluid flow may be implemented using compression and resulting pressure to the fluid retainment area, to communicate fluid to a supply or reservoir of flavoring or supplements or the like in the second compartment through a pressure actuated bidirectional valve. The fluid communicated to the second compartment returns to the fluid supply of the first compartment mixed with concentrate or supplements or flavoring or the like, by inverse pressure actuating the valve mechanism to reverse fluid flow. This can occur for one of two reasons. Either a suction or negative pressure is generated in the first compartment when compression thereof ceases, or in addition, the second compartment is configured to elastically store the pressure therein and thereby have a higher pressure than the first compartment upon cessation of compression thereof.

The device in use may be employed to transport a liquid such as water in the first compartment and a solute or concentrate such as a protein powder supplement or a syrup for flavoring or other fluid-soluble mixture in the separate second compartment. This maintains the fluid and mix separate prior to use and fresh in both respective compartments prior to a communication of some or all of the water supply with the compartment containing the supplement.

Subsequent to a user-induced mixing of fluid between the two valve-separated compartments, the water or fluid may be consumed during or after strenuous physical activity or as needed. The device in a particularly favored mode is cylindrical in shape for easy gripping, compression, and retainment in the hand of a user. In order to insure proper cleaning, each of the two compartments of the housing is preferably separable for cleaning thereof and cleaning any valve mechanism positioned therebetween. Using the cartridge for a second compartment it is preferable that the valve be engaged in the wall of the cartridge and thus replaced with each use.

The liquid such as water held in the first compartment is engageable in an operative communication with a means for dispensing the fluid or water, which is positioned at a first end thereof. Such dispensing means can include an sealable opening or valve allowing ingestion by the user when moved to an open position. Sidewalls of the compartment are preferably sufficiently flexible such that they can be compressed between the thumb and fingers of a user. Opposite the drinking or dispensing end of the first compartment, the valve mechanism component is situated to provide a sealed bi-directional communication of the fluid in the first compartment and the mix or concentrate in the second compartment.

The valve mechanism separates fluid communication from the first or main compartment holding the liquid supply, with the smaller second or solute compartment housing a powder or syrup or concentrate or the like which is adapted to dissolve in the water or liquid communicated from the first compartment. The valve mechanism may either mate with both the first and second compartments, or in some modes it may be formed partially or entirely into housing of the second compartment and operatively mate with the first compartment. As noted the second compartment may be removably engageable to allow for the employment of sealed containers or cartridges such as K-cups to be employed by the user, and the placement of the valve in the cartridge is preferred to allow replacement thereof with each use.

The valve mechanism in all preferred modes of the device, is pressure actuated such that compressing the area of the first compartment housing the fluid such as water, will cause a pressured communication of a portion of the fluid into the second compartment. Upon cessation of the communication of pressure to the first compartment by the user, fluid communicated to the second compartment which has been mixed with concentrate or flavoring or the like, is substantially returned from the second compartment, through the valve, to mix with the remaining fluid in the first compartment.

In one configuration of the device the pressure actuated valve mechanism employs a dampened spring-like system with two modes of operation. In operation, a squeezing of the sidewalls of the first compartment of the device will impart pressure to the first compartment. This pressure will force the valve to temporarily open when there is positive pressure acting on its surface from the first or main solvent compartment. Cessation of pressure stops fluid communication to the second compartment and a return thereof to the first compartment. This action allows for multiple sequential partial mixing with the solute compartment through the valve.

A dampening mechanism of the spring-like valve mode of the device prevents the valve from immediately shutting when the pressure is released, or when the compressive means is removed from the first compartment hosting the liquid supply. The dampening effect and slight time delay of closure of the valve, may be created by the presence of a closed-cell foam, gasket, or elastic air cushion between the spring mechanism and the valve's resting planar surface.

The spring-like component of the pressure actuated valve mechanism is also configured to allow for a second operating mode. In this mode if a significant biasing force or pressure, over a threshold force, acts upon the valve's surface, a spring or biasing means urging the valve closed, will translate and will lock in the open position. This positioning maintains a continuous communication between fluid in the first compartment and mix in the second compartment. Such a biasing force may be created by impacting the housing on a surface at the distal end, opposite the dispensing end. The impact force from the contact communicates the fluid in the liquid compartment against the surface of the valve surface, thereby overcoming a threshold bias level holding it closed, and rendering it fully open passed its locking, or inversion point.

This translation of the pressure actuated valve toward the second compartment and the end of the device impacting a surface, which locks open the valve allows, opens a communication and allows for complete continuous mixing of the two compartments. The valve translates toward the distal end to remain open due to an arced annular wall of material forming a spring or bias of the valve closure toward the first compartment which must be overcome by pressure, or a force above a threshold level. The spring in this annular arch is configured such that when sufficient force is imparted to translated the annular section a distance toward the second compartment, the arced wall forming the biasing force will invert and lock the valve in the open position.

When the valve is locked open, the mixing of the liquid and solute may be facilitated by shaking the device and thereby forcing the solution to pass through an optional amalgamating membrane or webbing that may be attached to the valve. In some embodiments, the membrane or webbing may act as the spring in the valve mechanism and may be hemispherical or dome-like. A hemispherical or dome-like webbing or polymer material may also operate with the same principles as an inverting flat spring, as the flexible webbing may invert as well. The amalgamating membrane or webbing may also be an optional clip-in component.

The spring-like component may be formed of stainless steel, spring steel, plastic, or similar materials. The valve-mechanism component is centrally located and has mating surfaces such as complimentary threaded surfaces on both ends. However, they may be formed in such a way that the mechanism can be removed and the solute and liquid compartments may be attached to each other.

In another preferred mode of the device the pressure actuated valve component can be formed of flexible polymeric material to cause a pressure-directed communication of liquid from the first compartment to be mixed with the mixture stored in the second compartment when the first compartment is compressed. Pressure imparted to the fluid supply from compression of the sealed first compartment causes fluid to communicate through the pressure actuated valve into the second compartment. Cessation of compression of the first compartment causes the pressure therein to return to normal whereafter the fluid communicated to the second compartment which stores the pressure by flexing or stretching is returned having been mixed with the contents of the second compartment.

The return of fluid from the second compartment to the first is caused by a suction generated in the collapsed first compartment upon cessation of compression and a stored pressure in the second compartment if formed to do so. A deformable wall of the second compartment which is elastic, contracts to an un-stretched position thereby imparting pressure into the second compartment causing communication of fluid therein from the first compartment, to return through a valved channel to the first compartment. This mode allows for the incremental mixing of the fluid from the first compartment to the second, and incremental returning of fluid to the supply in the first compartment. Thus, the user can impart more or less mixture from the second compartment to the first, depending on the number of times the first compartment is compressed to cause the mixing and return of fluid to the first compartment from the second.

The solute, supplement or concentrate holding second compartment may be formed of the same material as the liquid compartment but may be smaller in volume. The second or solute compartment if exposed, or the housing of the device, may also have a removable padded base that mates with the surface opposite the valve mechanism mating surface to protect it during impact valve operation. As noted, there may also be a lid for the first compartment, or it may be a sealed removable component thereby enabling it to be used separately from the device, or used interchangeably with multiple vessels and devices.

In all modes of the device, the compressible first compartment when pressurized by compression of the walls of the first compartment, will actuate the pressure actuated valve component to cause a flow of fluid into the second compartment. Thereafter in all modes, when pressure upon the first compartment ceases, stored pressure in the second compartment will reverse the flow through the valve component and communicate the mixed fluid back to the first compartment. Thus the valve component has a first position wherein substantially all fluid communication in either direction is prevented. Further it has a second position wherein the valve component opens to allow fluid flow in the direction from higher pressure to a lower pressure compartment until pressure equalizes and the valve component moves again to the first position.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed fluid mixing and reservoir device. It is important, therefore, that the claims be regarded as including such equivalent construction and methodology insofar as they do not depart from the spirit and scope of the present invention.

BRIEF DESCRIPTION OF DRAWING FIGURES

Figures 6, 6A:
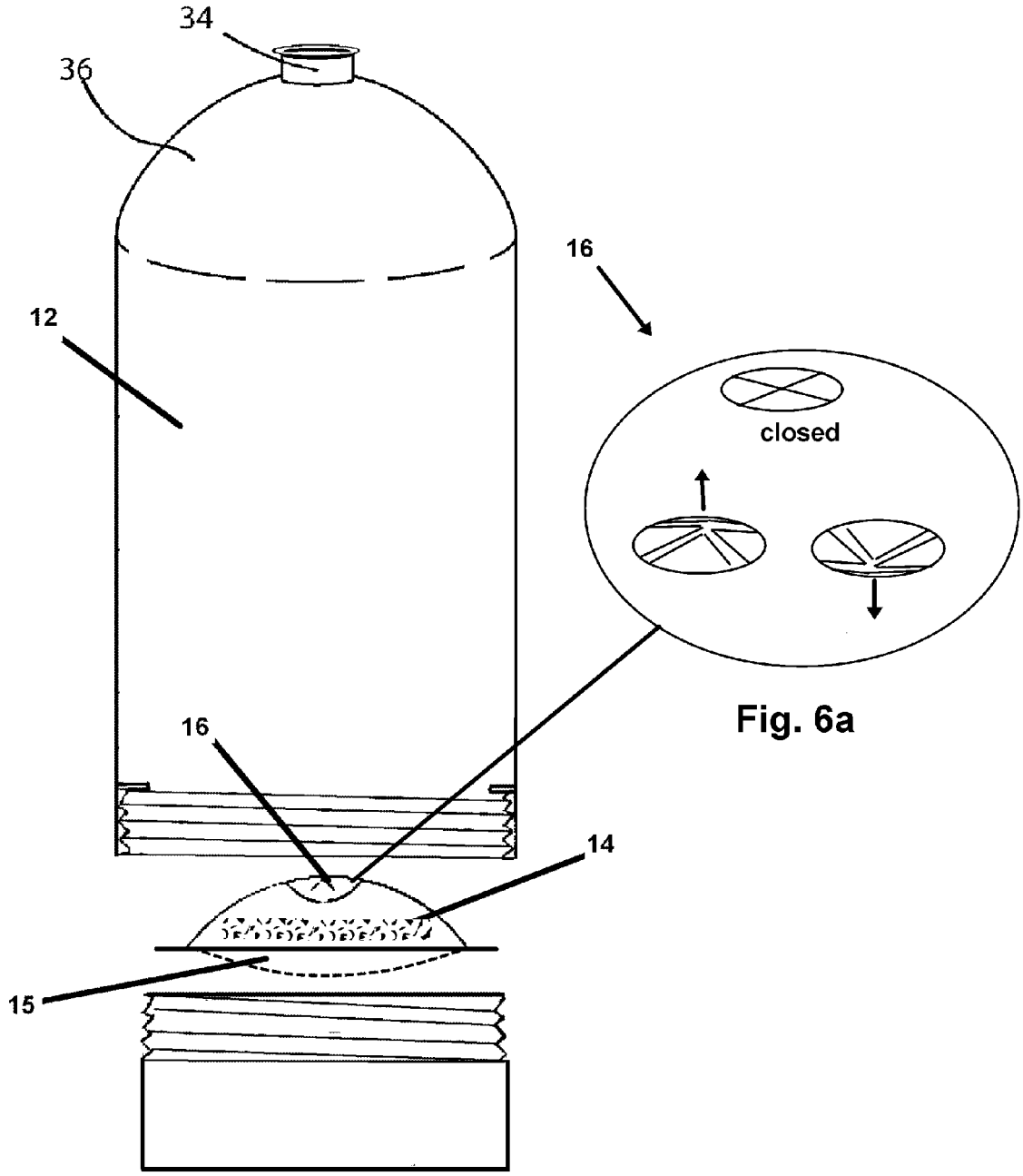
FIG. 6 shows a particularly preferred mode of the device having a second compartment which is engageable to the device and later disposable, and employs a cartridge-positioned pressure activated dual flow valve mechanism to provide communication of fluid between the second compartment and first.

FIG. 6*a* depicts an example of a pressure actuated dual flow valve showing the closed and flow-actuated positions allowing mixing of concentrate in the second compartment with fluid in the first compartment.

Figure 7:
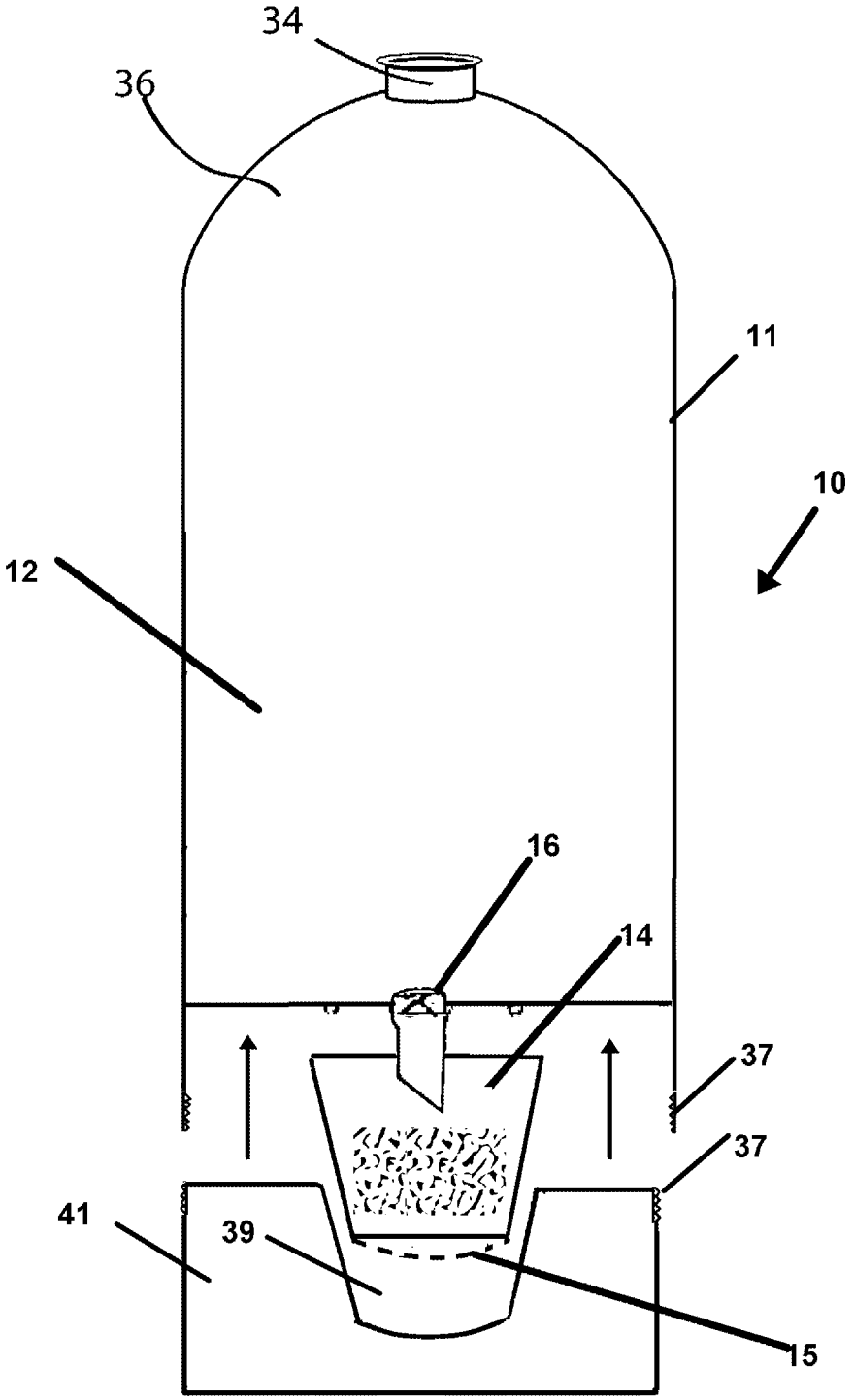

FIG. 7 shows a mode of the device having another mode of engageable cartridge providing a disposable second compartment shown in the form of a K-cup for purposes of illustration only, and could be any shape or dimension.

Figure 8:
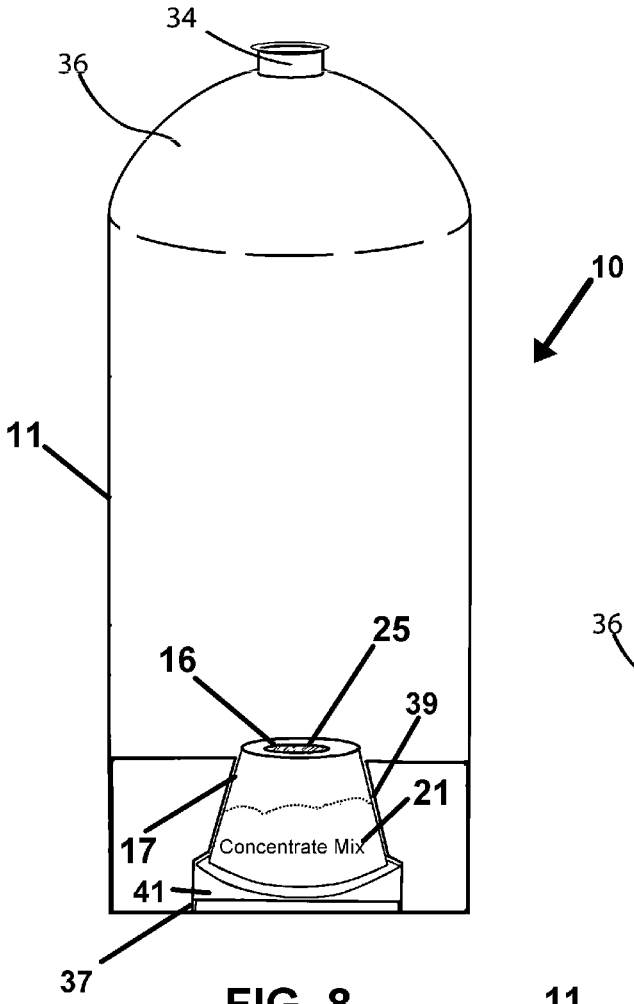

FIG. 8 depicts a mode of the device wherein the engageable cartridge has a pressure-openable or liquid-openable seal which communicates into the lower end of the fluid reservoir of a closeable container housing.

Figure 9:
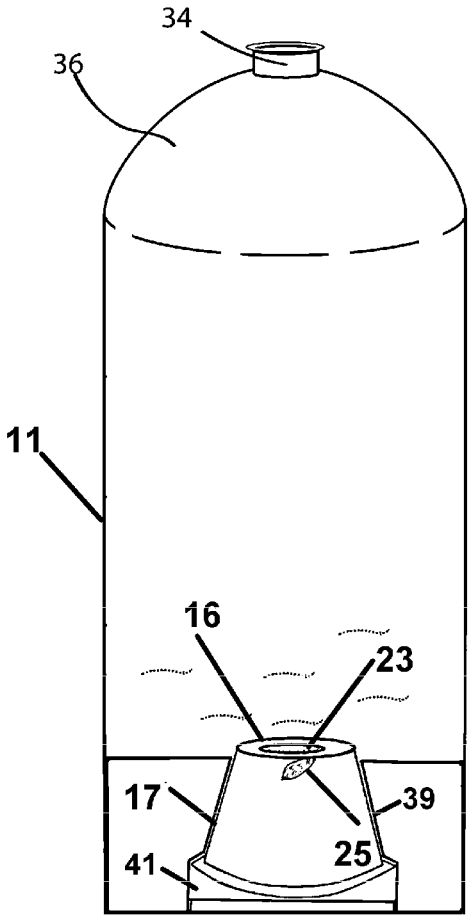

FIG. 9 shows the device of FIG. 8 wherein pressure from squeezing the sidewalls, or communication with the fluid, has opened the foil or aperture cover of the cartridge such that the concentrate within the cartridge mixes with the fluid.

Figure 10:
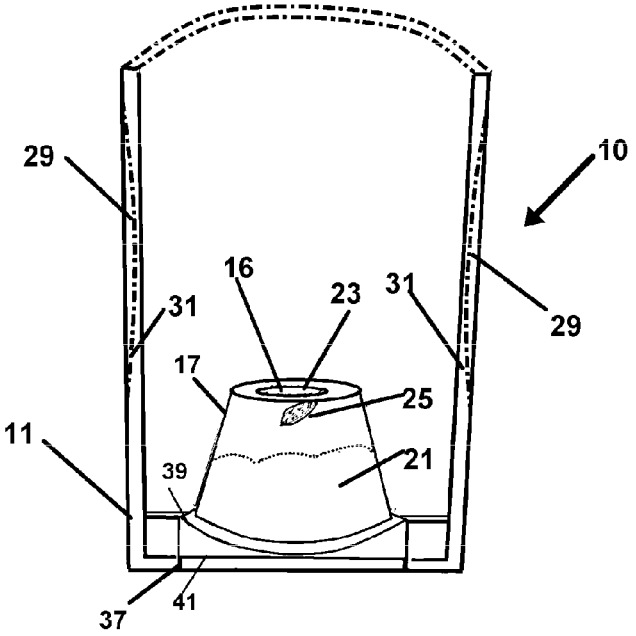

FIG. 10 depicts the device employing an open end fluid vessel such as a glass or large cup, and showing the open cartridge aperture caused by fluid communication therewith, or using pressure from squeezing the flexible sidewalls with an engageable lid attached to the open end.

DETAILED DESCRIPTION OF THE PREFERRED EMBODIMENTS OF THE INVENTION

Figure 1:
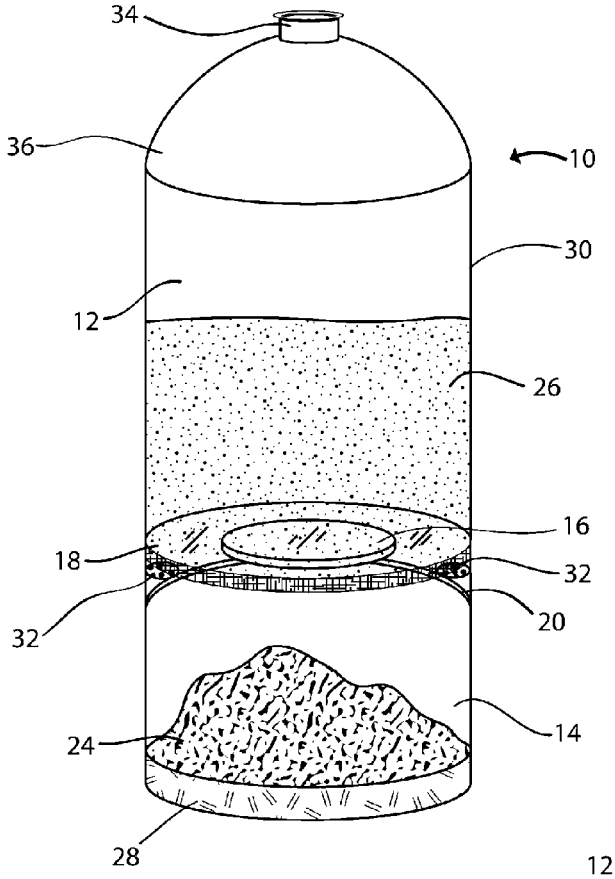
FIG. 1 depicts a perspective view of the device depicting a liquid such as water in a first compartment and a solute mix such as powder or syrup in a second compartment, separated by a valve mechanism configured to seal a communication aperture.

Referring now to the drawings of FIGS. 1-10, are the modes of the device 10 employed for the transport, containment, mixing and dispensing or drinking of a mixed-beverage of the liquid housed in a first compartment 12 of the container 11 and the mixture housed in a second compartment 14. FIG. 1 depicts the device 10 in one preferred embodiment that includes a first or liquid compartment 12 in operative engagement with a solute or second compartment 14. A communicating pathway therebetween is separated by a valve 16 to prevent the premature mixing of each compartment's respective contents.

Figure 4:
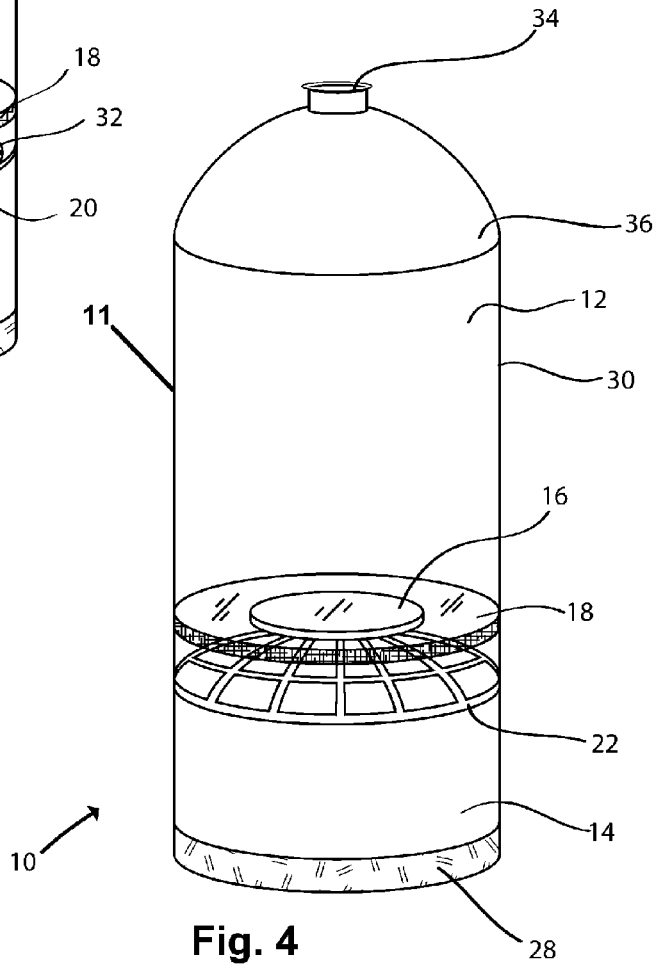
FIG. 4 depicts a perspective view of the device with a different type of inverting spring used in the valve mechanism that incorporates an amalgamating structure.

The valve 16 in this mode is shown seated within a resting structure 18 in a closed state blocking communication between the first and second compartment, and supported by an inverting spring 20. The inverting spring shown may be made of stainless steel, spring steel, or plastic in various forms. The inverting spring 20 may also be replaced by various shapes and forms as shown in FIG. 4 where it takes on the form of an inverting and amalgamating dome spring mechanism 22 to accomplish other goals such as the improved mixing of solutes 24 and liquids 26.

The inverting spring 20 shown in FIGS. 1, 2, 3 and 5 enables the liquid compartment 12 to remain isolated from the solute compartment 14 until a time of desired mixing. The valve 16 may translate away from an aperture communicating with the first compartment 12 to fully and instantly open communication between both compartments, through an impact of the padded base 28 upon a surface.

Figure 2:
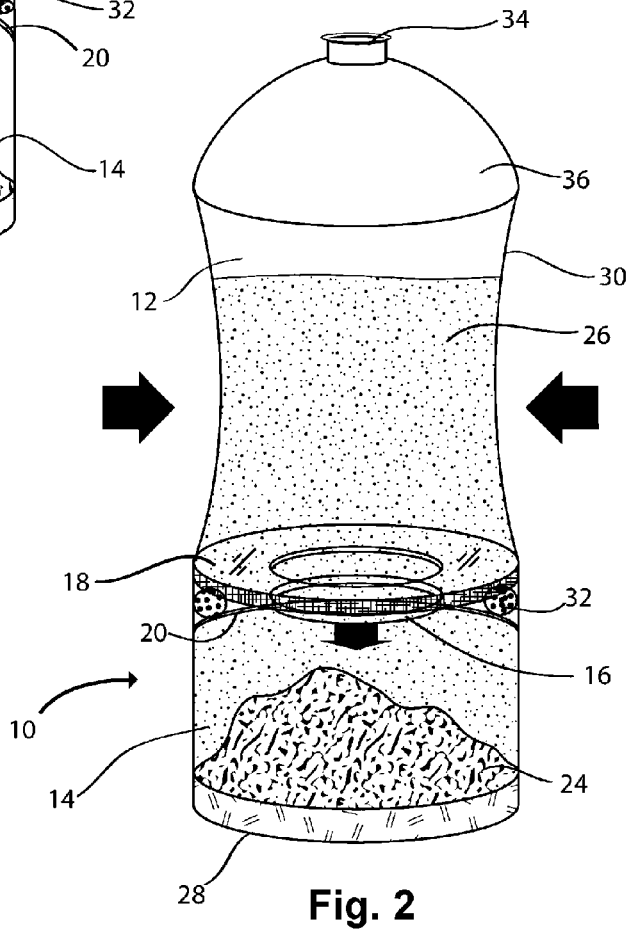
FIG. 2 is a perspective view of the device illustrating the mixing of the solute from the second compartment and liquid from the first compartment, caused by a temporary opening of the valve mechanism caused by the squeezing of the flexible walls surrounding the liquid compartment.

In some modes of the device, the valve 16 mechanism can be activated incrementally, and opened and sealed sequentially, by the squeezing and compressing of the first compartment walls 30 as shown in FIG. 2. Such compression causes a temporary pressurization increase in the first compartment 12 and opens the valve mechanism to allow a short duration of mixing of the fluid in the first compartment 12, with the mixture in the second compartment, allowing the user to determine the amount of mixture which is communicated back into the liquid in the first compartment 12 to make a stronger or weaker mix. This allows the device to be refilled once the original supply of fluid in the first compartment 12 has been consumed, and the process repeated in this sequential short mixing mode. In other modes the valve 16 may be included in an insertable cartridges 17 defining the second cavity 14 and would be replaced with each new cartridge 17 inserted.

In the valve mechanism of FIGS. 1,2, 3 and 5 there is also illustrated a dampening component 32 located between the inverting spring 20 and the valve's resting structure 18. The dampening component 32 in FIGS. 1 and 5 appear compressed relative to other figures due to the valve 16 being closed and the corresponding inverting spring 20 pressing the dampening component 32 against the valve's resting structure 18.

This dampening component 32 slows the closing and sealing action of the valve 16 after the liquid compartment walls 30 have been compressed and the valve 16 has been actuated as shown in FIG. 2. Shown in FIG. 2 is the dampening component 32 no longer compressed due to the increase in separation between the inverting flat spring 20 and the valve's resting structure 18. The compression or contraction of the dampening component 32 when the walls 30 are squeezed to impart pressure into the device, enables a slowed closing by providing a resistance bias to the inverting flat spring 20 as the dampening component 32 compresses, while also allowing a small amount of fluid which was squeezed through from the solute compartment, to return.

The dampening and slow-closing action and expansion of the dampening component once compression to the sidewalls ceases, enables the device 10 as noted to "burp," or sequentially mix small portions of the liquid 26 with small portions of solute 24. This "burping" or temporary mixing is shown in FIG. 2 and enables the user to obtain small amounts of the solute 24 in the liquid 26, which is desirable with concentrated additives. As noted, this action also enables a user to mix small amounts and consume them, and subsequently refill the liquid compartment 12 multiple times with an easily accessible fluid such as water before needing to replenish the solute 24 while still enjoying the solute flavors or supplement benefits.

In all figures the device 10 is shown with a dispensing nozzle 34 affixed to the domed peak of a removable lid 36. This nozzle should be formed in such a way that an opening due to internal pressure will not occur during a compressive biasing of the compartment walls 30.

Figure 3:
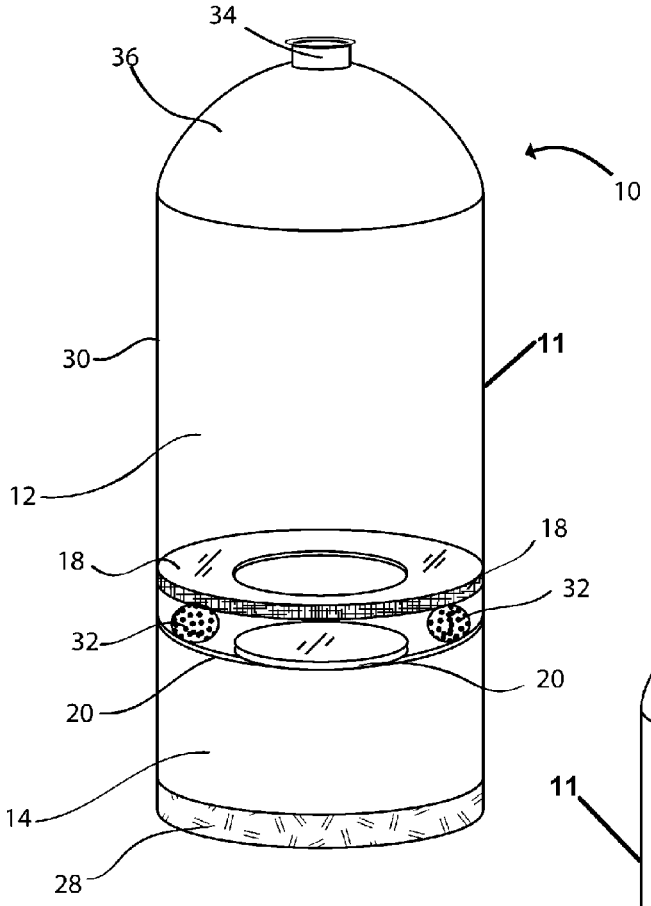
FIG. 3 depicts a perspective view of the device with the solute and liquids removed after it has been impacted upon a surface, thereby inverting the valve-spring mechanism and fully opening the valve until it is reset manually.

FIG. 3 depicts the device 10 where the inverting spring 20 is inverted and the valve 16 mechanism is thereby locked open. This open-valve mode occurs after the base 28 has impacted a solid surface, thereby transferring the kinetic energy of the device through the liquid 26 and against the surface of the valve 16. That transfer of energy applies a significant biasing which is relational to the surface area of the valve 16 and overcomes the biasing force of the spring forcing the valve 16 to an open position. As expected in this mode, the dampening component 32 does not appear to be compressed as this is the maximum space allowable between the inverting flat spring 20 and the valve's resting structure 18. In this mode, the solute 24 and liquid 26 mix into a solution and become the desired mixed beverage that is ready for consumption.

Shown in FIG. 4 is the device 10 with a replacement component for the inverting spring 20. In this embodiment, an inverting and amalgamating dome-spring mechanism 22 is present to provide resistance biasing to the valve 16 toward sealing the first chamber from the second, as well as facilitate the mixing of solutes 24 and liquids 26 upon impact and translation of the spring. In this embodiment, the dampening component 32 mentioned previously is not shown, but may take on the form of an air cushion-donut or ring-like gasket due to the shape of the inverting and amalgamating dome-spring mechanism 22. Also, the space between the webbing of the inverting and amalgamating dome-spring mechanism 22 allows fluid solutions to pass through while creating turbulence during device 10 shaking, thereby assisting in the amalgamation of the solute 24 and liquid 26. This action helps to prevent dry chunks from remaining in the solution when a powdered solute 24 is used.

Figure 5:
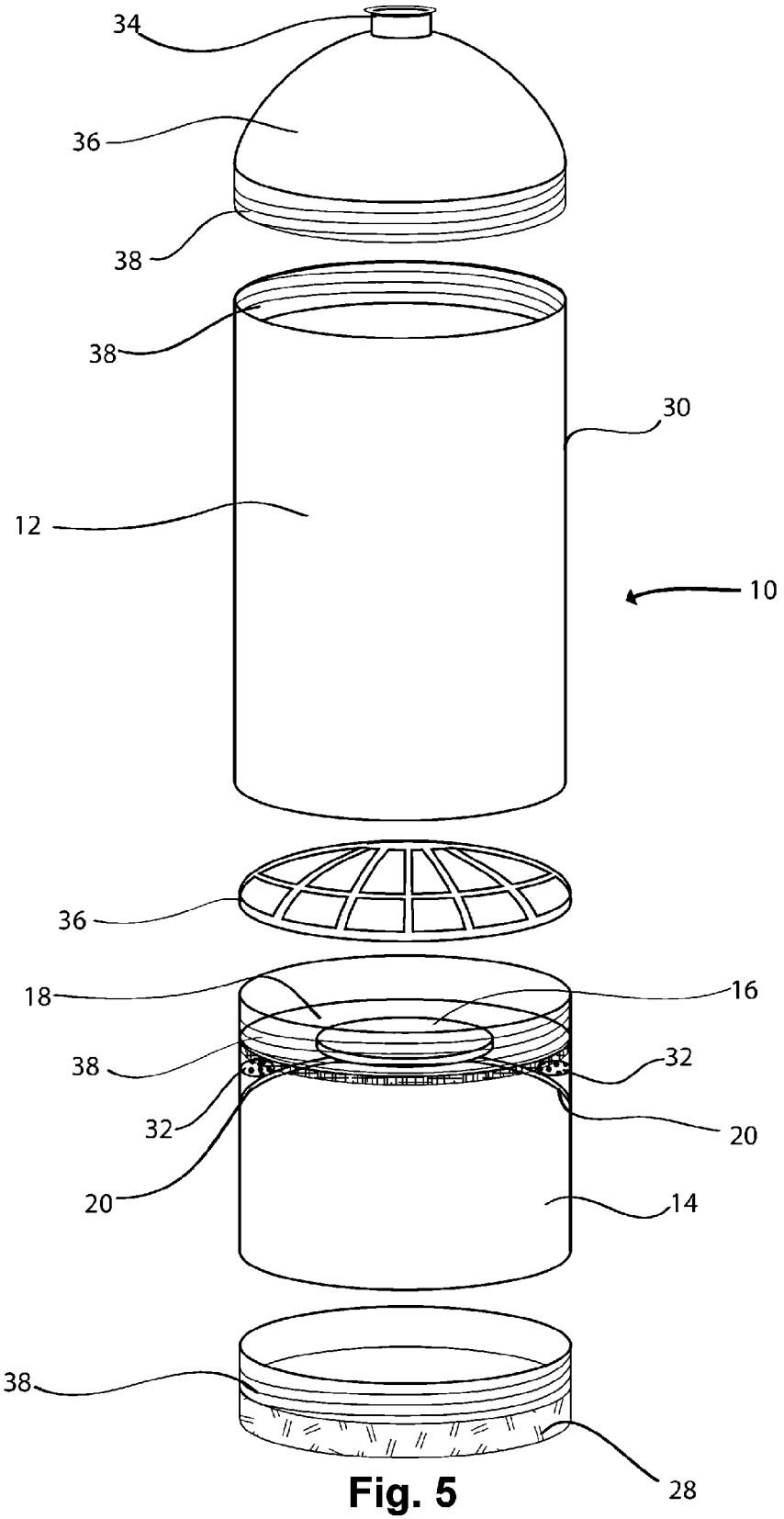
FIG. 5 depicts a perspective exploded view of an example of the device illustrating the mating and removable component properties.

If the amalgamating properties of the inverting and amalgamating dome-spring mechanism 22 are only sometimes desired, an embodiment shown in FIG. 5 illustrates a removable amalgamating webbing 36 that may clip into the device 10. This amalgamating webbing 36 may be used in conjunction with the more simple inverting flat spring 20, and should accomplish the same mixing functions as the inverting and amalgamating dome-spring mechanism 22.

FIG. 5 also depicts the device 10 with all components separated in an exploded view. This illustrates that different components may be mated through the employment of complimentary threaded surfaces 38, and the components should be interchangeable. This interchangeability enables a user to omit the valve 16 and solute compartment 14 by attaching the padded base 28 directly to the liquid or first compartment 12. It also shows that the solute housing second compartment 14 can be treated as an individual container if a mating lid is attached to its complimentary threaded surface. Padded base 28 components may act as a mating lid in this circumstance. This enables a user to carry multiple solute compartments 14 with different solutes 24 for attachment to a single liquid compartment 12.

In FIG. 6 shown a particularly preferred mode of the device 10, having a second compartment 14 formed by a cartridge, which is removably engageable to the device 10 and later disposable. Such will allow users to buy the mixture prepackaged in the cartridge forming the second compartment 14 which would be provided sealed therein and will allow for commercial sales in stores and for instance in vending machines. The cartridges can be sold or dispensed having onboard valves 16 engaged to the cartridge defining the sealed second compartments 14, and may have any of a plurality of different mixes housed therein for different purposes when mixed with the liquid of the first compartment 12. Upon finishing use of the mixture in the cartridge defining second compartment 14, it may be disposed and replaced with another. Of particular note is that having the valve 16 engaged with the cartridge allows for replacement of the valve 16 with each cartridge change. Of course the second compartment 14 if formed of an engageable cartridge, might also be refilled and resealed.

As shown, the pressure activated valve mechanism 16 in this mode employs a pressure activated dual flow valve 16 mechanism to provide communication of fluid between the second compartment 14 and first 12. The valve 16 engaged between the first and second compartment 14 is pressure activated to open and allow flow in either direction, but toward the compartment with lowest pressure until such is normalized. In this mode when force is imparted to the first compartment 12, fluid is forced into the removable second compartment 14 or cartridge. Upon cessation of compression of the first compartment 12, suction is generated by the collapsed walls returning to a normal position which helps cause the return of fluid mixed with concentrate in the second compartment 14 to the first compartment 12. Stored pressure can also be employed to induce the reverse flow from the second compartment 14 to the first in combination with the suction formed therein.

As shown, a deformable wall 15 of the second compartment or cartridge may be elastic and employed to store pressure energy. Once pressure from the first compartment 12 ceases, and suction forms in the first compartment 12, the wall 15 contracts to an un-stretched position thereby imparting higher pressure into the second compartment 14 than the first, thereby causing communication of fluid therein to the first compartment 12 through the valve 16 mechanism. In this removable and replaceable cartridge mode of the second compartment 14, the valve 16 is continually replaced and helps avoid contamination from food or material which may become lodged in the valve 16. While it should be in now way considered limiting, shown in FIG. 6*a* is an example of a pressure-actuated dual-flow valve 16. While any such valve which substantially ceases communication between two compartments when pressure in both are substantially equal can be employed, the example in FIG. 6*a* shows the operation of such simple and inexpensive valves.

The valve 16 has a first position shown as the closed mode where flaps formed by slits in a flexible plastic or polymeric sheet are substantially in contact with each other along perimeter edges. In first position or the closed mode, fluid communication is substantially prevented between the two compartments on either side of the valve 16. Also shown is a second position of the valve 16 allowing flow from the compartment with the highest pressure, toward the compartment with the lower pressure which as shown can be in either direction deponing on the relative pressure differential between the two compartments.

The valve 16 in the mode of the device 10 with permanent first and second compartments may be engaged therebetween. In the preferred mode of the device 10 employing replaceable cartridges for the second compartment 14, the valve 16 may be engaged with the cartridge to allow the user to renew the valve 16 with each new cartridge which will be a significant improvement over current devices where internal valves can become contaminated with grime and germs and bacteria if left unwashed after use.

By substantially prevented is meant that none or minor amounts, such as fractions of a milliliter, will communicate across the closed valve 16. The other two modes of the valve 16 show fluid flowing away from the valve in a direction away from the compartment with the higher pressure. Such will occur when the bottle is compressed to communicate fluid past the valve into the second compartment 14 or disposable cartridge.

This flow will reverse when compression of the first compartment ceases, causing a suction to develop from the walls moving to the uncompressed position and dropping pressure, and pressure in the second compartment 14 or cartridge becoming higher, due to elastic walls of the disposable cartridge, or a flexible membrane in the second compartment 14 storing the pressure energy which rebounds upon cessation of compression of the first compartment. In this fashion a pressure actuated dual flow valve 16 providing the valve mechanism between the compartments, allows the fluid under higher pressure from the first compartment to mix with concentrate in the disposable cartridge or second compartment 14, and return the mixture to the fluid in the first compartment upon cessation of compression thereof which lowers the pressure in the first compartment lower than that of the second compartment 14.

Of course those skilled in the art will realize, that any pressure actuated dual flow valve 16 can be employed to regulate the flow in the container 11 between the first compartment and second compartment 14, to allow more or less concentrate from a cartridge or second compartment 14 to be mixed with the fluid in the first compartment. As such, any such valve which will provide flow in-between the two compartments in a direction from higher pressure to lower pressure, and substantially eliminate such fluid communication when pressure between the two compartments is equal, is anticipated within the scope of this application and claims.

There is seen in FIG. 7 a mode of the device 10 having another configuration of a container 11 having a replaceable and disposable second compartment 14 such as an engageable cartridge 17 as shown in FIGS. 7-10. As depicted for illustration purposes only, and in no manner limiting on dimensions or shape of the engageable second compartment 14, there is shown a "K-cup" dimensional configuration of a cartridge 17 which may be formed with elastic walls, which will be easily manufactured due to widespread use of such a configuration for coffee makers and the like. This mode may include the valve mechanism 16 such as in FIG. 6 if the body of the second compartment 14 is elastic in nature. Or, it may be configured to engage with a one way valve as shown, or with a valve 16 system positioned in an aperture in the cartridge itself which opens in reaction to fluid communication for a time duration, or pressure generated by compressing the sidewalls, or both.

As shown in FIG. 8, the container 11 of the device 10 can employ cartridges 17 to provide an engageable second compartment 14 of the device 10 wherein the engageable cartridge 17 defining the second compartment 14 has a pressure-openable or liquid-openable seal engaged around an aperture 23 providing the valve 16. The aperture end of the cartridge 17 is positionable into the lower end of the first compartment 12 defining the fluid reservoir of a closeable container 11 housing. In this mode of the device 10, squeezing the flexible sidewalls will communicate pressure to the first compartment 12 and against the seal 16 in the cartridge 17 mode of the second compartment 14 such that it will either peel pack in its adhesive engagement, or rupture, or otherwise allow communication of fluid freely between both the first compartment 12 and the second compartment defined by the cartridge 17.

FIG. 9 shows the device of FIG. 8 wherein pressure from squeezing the sidewalls, or communication with the fluid for a duration of time, has caused an opining between the body of the cartridge 17 and foil or aperture cover forming the valve 16 of the cartridge 17 defining the second compartment 14, such that the concentrate 21 within the cartridge 17 defining the second compartment 14, freely mixes with the fluid from the first compartment 12 through an open aperture 23. In all modes where a cartridge 17 is employed as the second compartment 14, it is engaged operatively through a passage, and/or positionable in a complimentary dimensioned cavity 39 within a removably engageable lower housing 41 or the like, to hold it in place until the valve 16 formed in the endwall of the cartridge 17 is ruptured, separated, or otherwise opened by one or a combination of pressure in the first compartment 12 or fluid communication which dissolves adhesive holding the closure 25 sealed over the aperture 23 in the cartridge 17 sidewall.

FIG. 10 depicts the device 10 employing an open end fluid container 11 such as a glass or large cup, and showing the opened cartridge 17 aperture 23, caused by fluid communication therewith and/or pressure against the closure 25 of the aperture 23 from squeezing the flexible sidewalls forming the first compartment 12 of the container 11 with an engageable lid (not shown) attached to the edge at the open end. A complimentary cavity 39 is formed to accept and seal against the edge of the cartridge 17 to hold it in place as earlier shown and described. Deformable walls 26 can be formed in the sidewalls of the container 11 by positioning an air cavity 31 therein. Alternatively, the two-way valve 16 form FIGS. 6 and 8, may also be employed within the aperture 23 as with other modes of the device 10 herein using the closure 25, when a permanent opening is not desirable with continuous mixing, and where sequential mixing of fluid and concentrate based on compression of the first compartment is desirable to allow the user a means to increase or decrease the mix of concentrate 21 with the fluid based on the number of compressions.

While all of the fundamental characteristics and features of the liquid mixing and transport device herein have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A beverage container having a compressible liquid compartment, for containing a liquid and a cartridge that is engageable with the beverage container, the cartridge comprising a concentrate compartment adapted for storage of a concentrate;

a housing at least partially defining the concentrate compartment;

a deformable elastic wall coupled to the housing and at least partially defining the concentrate compartment;

a dual flow valve coupled to the housing;

said valve allowing fluid flow from the concentrate compartment into the liquid compartment when pressure in the concentrate compartment is higher than in the liquid compartment, and allowing fluid flow from the liquid compartment into the concentrate compartment when pressure in the liquid compartment is higher than in the concentrate compartment, said flow ceasing when pressure between the two compartments is normalized, wherein said liquid compartment is compressible by hand to increase the pressure in said liquid compartment above that in the concentrate compartment thereby forcing liquid in the liquid compartment through the valve and into the concentrate compartment to mix with concentrate in the concentrate compartment, said elastic wall thereby expanding and storing pressure such that when the compression by hand of the liquid compartment is released pressure in the concentrate compartment is higher than the pressure in the liquid compartment, such that mixed liquid and concentrate is forced from the concentrate compartment through the valve and into the liquid compartment by contraction of the elastic wall, the mixed liquid and concentrate for consumption by a user of the beverage container.

2. The beverage container of claim 1, further comprising a dispensing nozzle at a top portion of the beverage container, the cartridge being removable and replaceable at a bottom portion of said beverage container.

3. The beverage container of claim 1, wherein the liquid compartment is compressible by hand and the hand pressure can be released to allow for multiple sequential partial mixing between the liquid and concentrate compartments through the valve.

* * * * *